US008166582B2

(12) United States Patent
Johnson

(10) Patent No.: US 8,166,582 B2
(45) Date of Patent: May 1, 2012

(54) GENERATED WAVE PROPULSION WATER FEATURE

(76) Inventor: Garrett T. Johnson, Virginia Beach, VA (US)

( * ) Notice: Subject to any disclaimer, the term of this patent is extended or adjusted under 35 U.S.C. 154(b) by 442 days.

(21) Appl. No.: 12/387,451

(22) Filed: May 1, 2009

(65) Prior Publication Data

US 2009/0217451 A1 Sep. 3, 2009

Related U.S. Application Data

(63) Continuation-in-part of application No. 12/286,632, filed on Oct. 1, 2008, and a continuation-in-part of application No. 11/290,905, filed on Nov. 30, 2005, now abandoned.

(51) Int. Cl.
*A47K 3/10* (2006.01)

(52) U.S. Cl. ..... 4/491; 405/79

(58) Field of Classification Search ..... 4/491; 405/79
See application file for complete search history.

(56) References Cited

U.S. PATENT DOCUMENTS

| | | | | |
|---|---|---|---|---|
| 2,056,855 | A | 10/1936 | Herz | |
| 3,802,697 | A | 4/1974 | Le Mehaute | |
| 4,174,808 | A * | 11/1979 | Latin | 239/23 |
| 4,276,664 | A * | 7/1981 | Baker | 4/491 |
| 4,515,500 | A | 5/1985 | Bastenhof | |
| 4,522,535 | A | 6/1985 | Bastenhof | |
| 4,558,474 | A * | 12/1985 | Bastenhof | 4/491 |
| 4,720,210 | A | 1/1988 | Stoner et al. | |
| 4,805,897 | A | 2/1989 | Dubela | |
| 5,186,578 | A | 2/1993 | Perslow | |
| 5,226,747 | A | 7/1993 | Wang et al. | |
| 5,230,662 | A | 7/1993 | Langford | |
| 5,282,487 | A | 2/1994 | Timpany | |
| 5,364,208 | A | 11/1994 | Taguchi | |
| 5,503,597 | A | 4/1996 | Lochtefeld | |
| 5,507,601 | A | 4/1996 | Taguchi | |
| 5,536,210 | A | 7/1996 | Barber | |
| 5,544,983 | A | 8/1996 | Taguchi | |
| 5,611,671 | A | 3/1997 | Tripp, Jr. | |
| 5,720,056 | A * | 2/1998 | Aymes | 4/488 |
| 5,833,393 | A | 11/1998 | Carnahan et al. | |
| 6,224,342 | B1 | 5/2001 | Russell et al. | |
| 6,460,201 | B1 * | 10/2002 | Lochtefeld | 4/491 |
| 6,640,470 | B2 | 11/2003 | Chesner et al. | |
| 6,738,992 | B2 | 5/2004 | Lochtefeld | |

(Continued)

FOREIGN PATENT DOCUMENTS

| | | |
|---|---|---|
| JP | 5231395 | 9/1993 |

*Primary Examiner* — Gregory Huson
*Assistant Examiner* — Karen L Younkins
(74) *Attorney, Agent, or Firm* — Williams Mullen

(57) ABSTRACT

An alternative propulsion or motive force for the riders of water features based on generated waves. A wave generator may be used to propel individuals or vessels within a chute for recreation or transportation. In one form, a pool or container having a body of water is configured to support an artificial wave generator which uses compressed gas to discharge water and generate a wave-like motion within a body of water. A source of make-up fluid is configured to mitigate internal low pressure conditions caused by the water discharge to enable effective wave generation with reduced quantities of compressed air. Portions of the waves generated in a pool may be captured in a variety of ways by chutes for stand-alone rides or for portions of chutes in water slides.

21 Claims, 9 Drawing Sheets

U.S. PATENT DOCUMENTS 6,857,967 B2 2/2005 Loyd et al.
7,285,053 B2 10/2007 Henry et al.
7,478,811 B2 1/2009 Johnson
2004/0261858 A1 12/2004 Ferrel
2006/0253969 A1* 11/2006 Johnson ..... 4/491

* cited by examiner

GENERATED WAVE PROPULSION WATER FEATURE

CROSS REFERENCE TO RELATED APPLICATIONS

The present application is a continuation-in-part of U.S. application Ser. No. 12/286,632 filed Oct. 1, 2008, which is: (i) a continuation-in-part of U.S. application Ser. No. 11/786,652 filed Apr. 12, 2007, now abandoned, which claimed the benefit of priority to U.S. Provisional Application Ser. No. 60/878,784 filed Jan. 6, 2007; and which was is (ii) a continuation-in-part of U.S. application Ser. No. 11/732,233 filed on Apr. 3, 2007, now U.S. Pat. No. 7,438,080, which claims the benefit of priority to U.S. Provisional Application Ser. No. 60/789,000 filed on Apr. 4, 2006. The present application is also a continuation-in-part of U.S. application Ser. No. 11/290,905 filed on Nov. 30, 2005, which claims the benefit of priority to U.S. Provisional Application Ser. No. 60/632,278, filed Dec. 1, 2004. All of the above applications are herein incorporated by reference in their entirety as if fully set forth herein.

FIELD OF THE INVENTION

The present invention relates to water rides or activities. More particularly, the present invention is a recreational water feature incorporating artificially generated waves or swells with an improved wave generating system as a means of propulsion for riders.

BACKGROUND OF THE INVENTION

Millions of individuals visit water parks every year to enjoy, among other attractions, various types of water slides, flumes, etc. In particular, water slides are generally known in the field as providing recreation involving water based motion or rides.

One common and simple category of water slides involves a sloping chute by which gravity draws a stream of water down the slide. The chute is typically manufactured from fiberglass full or half round segments that are fastened together. Water is pumped to the high point and then released into the chute. Individuals who climb to the top of the slide carry a potential energy that enables them to slide down the water slide chute at a desired speed, such that the potential energy is converted to kinetic energy. The water reduces friction and may propel the riding individual. Some slides (e.g., personal raft slides) provide mats to improve the sliding action, while other slides (e.g., body slides) permit individuals to slide down without a mat. Straight and steep slides are sometimes referred to as speed slides; the steep angle, the absence of diversions or curves, and the effect of a consistent fluid flow layer reduce the influence of friction on the rider.

A second category of water slides is sometimes referred to as the serpentine slide. This slide converts the potential energy of the height of entry into kinetic energy, some velocity as the rider travels a tortuous path. Because of the effect of friction and loss of energy caused by changing different directions (i.e., acceleration) away from a simple fall, serpentine slides may be limited to slower speeds. In addition, in some cases the water flow may not be adequate throughout the slide for the individual to remain at speed. Thus, some serpentine slides may introduce water in at various points to reduce friction and assist in propelling the individual sliding. This may be accomplished by solenoid or control valves that provide localized discharges or "gushes" of water. Some serpentine slides may also begin at great heights in order to increase the amount of original potential energy and to overcome the tortuous path.

A modification of the serpentine slide is the introduction of a bowl slide; a bowl slide is simply a bowl shaped portion of the slide into which an individual enters while carrying some speed in a roughly tangential direction. Inertia carries the individual initially along a circular path within the bowl slide. Gravity and friction reduce the speed along this circular path until the individual falls into the center of the bowl where a hole releases them into a pool.

Another modification of the serpentine slide is the introduction of significant elevations or inclines within the serpentine path after initial access. Traditional waterslides lacked the means for imparting additional energy to the individual once they entered the slide—the course of the slide was traveled by expending potential energy. Elevations were small and limited because each incline consumed energy and reduced speed. Some slides seek to overcome the loss of energy by using pressurized water jets to impart additional energy to the sliding individual. For example, some methods are directed to imparting energy to sliding individuals by injection of high velocity water jets. This approach must balance energy imparted with avoidance of water build up and the potential for shock to the sliding individual. Water jets involve localized energy transfers solutions that risk causing some discomfort for the rider. However, water jets have enabled waterslides that explore somewhat roller coaster-like designs. Further, the imparting of additional energy extends the duration of a water slide.

Another way of extending the duration of a sliding experience is to introduce other activities within the water slide to create a multifaceted water based experience. This is not an imparting of energy to the rider, but the addition of various features. For example, in U.S. Pat. No. 5,421,782 also to Lochtefeld is described a loop with unidirectional flow connected to several water rides. Within the loop was disclosed a "sheet wave" generator combining submersible propeller pumps forcing a sheet of water up a proprietary incline suitable for boogie or body boards (See U.S. Pat. No. 4,954,014 to Sauerbier et al.) Individuals could move from activity to activity, including various types of water slides that discharged into the loop. While this invention combined slides or activities to enable an individual to remain in the water, it did not introduce a new way of injecting energy into any single water slide.

Further, some inventors have proposed water features involving inserting a structure shaped with a wave profile into flowing water within a channel. This feature is not a means of propulsion, but a feature of interest. As the water flows over the structure, it may give the appearance of a wave and support some activities, such as riding a tethered or spring mounted surfboard. Of course, this approach relies on placing structure within the area of activity in the channel, limiting its usefulness for certain activities. A rider falling into a channel with flowing water might strike the structure or the tethering apparatus. Accordingly, the speed of a rider of a water slide and the vulnerability of the rider renders this feature more appropriate for facilities other than water slides.

Thus, each of these features is limited in the means of propulsion, which is usually by the force of gravity (i.e., on both the individual and the water), or by the force of supplemental pressurized water gushes or jets. The pressurized water or gushes used to propel the rider has typically been created by the use of wave cannons. The wave cannon is a device described in U.S. Pat. No. 5,833,393 to Carnahan et al. ('393 patent), which is hereby incorporated by reference in its entirety. The wave cannon generally relies on submerged, elongated chambers (e.g., tubes), which can be effectively or substantially open at one end and substantially closed at the other end.

The wave cannon can create waves by releasing bursts of pressurized air that force water out of the chamber and into a body of water. The expelled water is generally a discrete volume defined by the chamber. As the water is forced out of the chamber, it can be used to form a wave. In general, the air follows the expelled water and escapes out the opened end of the water chamber and into the body of water. Water from the body of water begins to refill the chamber prior to escape of all of the air. Grading of the chamber can improve the escape of air and the refilling of the chamber. Although the '393 patent was primarily directed to wave generation, alternate applications, such as pumping, are feasible and may be desirable in certain configurations, with modification to the basic wave generating system.

In practice, it has been found that the '393 patent wave cannon chamber requires the release of sufficient quantity of pressurized air to expel fully the water in the chamber. That is, a release of air sufficient to create a two phase discharge flow, with a large air bubble forcing out a slug of water, has been shown to be effective in generating wave motion in a body of water. However, the volume of pressurized air needed to achieve such effective operation in many embodiments has proven to be somewhat expensive.

Increasing the volume and/or pressure of the air released has been found in some cases to stratify the air and water in the chamber, so that the air can escape along a portion or annulus of the chamber without discharging all of the water from the chamber. Such a partial discharge of water creates smaller, inferior waves. Of course, a release of excess compressed air that produces inferior waves is inefficient.

Reducing the volume and/or pressure of air released has also been discovered to be potentially problematic. If the air released is inadequate to discharge fully the water from the chamber, then depending on the pressure during discharge and that of the surrounding body of water, several problems can arise. First, the inadequate discharge of water from the chamber can cause inferior or low quality waves. Second, the discharge of water has been observed to be reverse, in some cases halting the flow outward and rapidly reversing flow direction so as to return back to the chamber with a significant impact. When the once expelled water returns into the chamber, it creates suction into the muzzle of the chamber, potentially posing a safety hazard to those in the wave pool.

Accordingly, it would be useful to have water feature comprising a wave cannon that is capable of effectively expelling a volume of water using a lower, economical quantity of pressurized air, without creating a flow reversal, potential safety issue, or an impact against the chamber. It would also be useful to have alternative forms of propulsion would improve the variety of water slides features and extend the duration of the water slide.

SUMMARY OF THE INVENTION

The present invention is directed to providing an alternative means of propulsion or motive force for the riders of water features. In particular, the following discloses a water feature for propelling a rider. The water feature comprises a basin for containing a body of water, the basin having a basin proximal end and basin distal end. The water feature also includes a water slide chute having a bottom and two sides, the bottom and two sides defining a channel suitable for receiving a rider. The channel comprises a channel proximal end and a channel distal end and is in fluid communication with the proximal end of the basin and the body of water. The channel is further adapted to contain at least a portion of the body of water within the chute. The water feature also includes at least one wave generator adapted to generate at least one wave within the body of water. The wave generator includes an elongated tubular chamber having a substantially closed rear end and a substantially open front end. The wave generator also includes an anchor for securing the chamber and for maintaining the chamber in a desired orientation with respect to the proximal end of the basin and the body of water, wherein the body of water is in fluid communication with the substantially open front end of the chamber. The wave generator further comprises a gas compression compartment in fluid communication with the substantially closed rear end of the chamber and a gas control valve in fluid communication with the gas compression compartment and the chamber. The gas control valve is adapted to operatively control the flow of compressed gas from the gas compression compartment to the chamber. The wave generator also comprises a make-up fluid conduit in fluid communication with the chamber. Actuation of the gas control valve is capable of causing compressed gas to be released into the rear end of the chamber to forcibly expel fluid within the chamber out of the open front end into the body of water. The make-up fluid conduit is adapted to introduce fluid into the rear end of the chamber to relieve low pressure in the chamber. The wave generator, the basin, and the channel are configured so that when the wave generator generates at least one wave within the body of water, the basin is adapted to receive the at least one wave and the channel is adapted to receive from the basin at least a portion of the at least one wave within at least a portion of the body of water contained within the chute to propel the rider.

The water feature may further comprise at least one river return to collect overflow fluid from the body of water, wherein the river return is in fluid communication with the body of water and the make-up fluid conduit. The make-up fluid conduit comprising a supply of make-up fluid, which may be selected from the group consisting of gas, liquid and mixtures thereof. The wave generator may further include a fluid control valve, such as a check valve, in fluid communication with the make-up fluid conduit and the rear end of the chamber, wherein the fluid control valve is adapted to control the introduction of fluid into the chamber, and wherein actuation of the fluid control valve causes the make-up fluid to flow into the rear end of the chamber when the chamber reaches a predetermined low pressure.

The gas compression compartment of the wave generator may comprise a compressed gas tank and a gas compressor, wherein the compressed gas tank is fluidly connected to the gas compressor. The volume of the compressed gas tank is at least equal to the volume of the chamber. The water feature may further comprise a discharge check valve coupled to a portion of the front end of the chamber to enable the discharge of the chamber to the body of water but substantially inhibit reverse flow from the body of water into the front end of the chamber.

In a further embodiment, the chute comprises a plurality of chutes, wherein the plurality of chutes is juxtaposed in parallel fashion. The wave generator may further comprise at least one computer processor and a control system operably connected between the gas compression compartment and the computer processor so as to enable computer control of the wave generator. The chamber may be positioned at an incline such that the slope between the rear end and the front end of the chamber ranges from about 0 to about 5 percent. The water feature may further comprise a pool, wherein at least a portion of the chute is located within the pool and wherein at least a portion of the body of water is located within the pool.

In yet another embodiment, the present invention is directed to a water feature for propelling a rider, the water feature comprising at least one pool containing a body of water having a resting water level. The water feature further comprises a water slide chute having a bottom, two sides, an upstream end, and a downstream end, wherein at least a portion of the chute is contained within the pool. The water feature also includes at least one wave generator for generating at least one wave within the body of water, the wave generator in fluid communication with the pool, the wave generator comprising an elongated tubular chamber having a substantially closed rear end and a substantially open front end. The wave generator also includes an anchor for securing the chamber and for maintaining the chamber in a desired orientation with respect to the body of water, wherein the body of water is in fluid communication with the substantially open front end of the chamber. The wave generator also includes a gas compression compartment in fluid communication with the substantially closed rear end of the chamber, and a gas control valve in fluid communication with the gas compression compartment and the chamber, the gas control valve adapted to operatively control the flow of compressed gas from the gas compression compartment to the chamber. The wave generator further comprises a make-up fluid conduit in fluid communication with the rear end of the chamber wherein actuation of the gas control valve causes compressed gas to be released into the rear end of the chamber to forcibly expel fluid within the chamber out of the open front end into the body of water.

The make-up fluid conduit is adapted to introduce fluid into the rear end of the chamber to relieve low pressure in the chamber. The wave has a trough water level in the body of water below the resting water level and a crest water level in the body of water above the resting water level, and wherein the chute is aligned in the direction of the wave and that the top of the sides of the portion of the chute contained within the pool are above the resting water level and below the crest water level, such that a portion of the at least one wave enters the chute in a direction moving from the upstream end to the downstream end of the chute. In one embodiment, the wave generator is not contained within the chute.

In yet another embodiment, the water feature further comprises a collection grate in fluid communication with the make-up fluid conduit for collecting the dissipated wave, wherein the resting water level is above the upstream end and below the downstream end of the chute.

In another embodiment of the present invention, a water feature is disclosed for propelling a rider, the water feature comprising a water slide chute having a bottom, two sides, an upstream end, and a downstream end, wherein the chute is adapted to contain at least a portion of a body of water within the chute. The water feature comprises at least one wave generator adapted to generate at least one wave within the body of water, wherein the wave generator is located at the upstream end of the chute. The wave generator also includes a make-up fluid conduit, which is adapted to introduce fluid into the rear end of the chamber to relieve low pressure in the chamber; and a fluid control valve in fluid communication with the make-up fluid conduit and the rear end of the chamber, wherein the fluid control valve is adapted to control the introduction of fluid into the chamber. Actuation of the fluid control valve causes the make-up fluid to flow into the rear end of the chamber when the chamber reaches a predetermined low pressure.

In still another embodiment of the present invention, the water feature further comprises a basin in fluid communication with the wave generator and chute, wherein the basin contains at least a portion of the body of water, and wherein the basin is located upstream of the chute and downstream of the wave generator. The wave produced by the wave generator has a trough water level in the body of water below the resting water level and a crest water level in the body of water above the resting water level. The chute in the water feature may be aligned in the direction of the wave such that the top of the sides of the chute are above the resting water level and below the crest water level. The water feature may further comprise at least one river return to collect overflow fluid from the body of water, wherein the river return is in fluid communication with the body of water and the make-up fluid conduit.

DETAILED DESCRIPTION OF PREFERRED EMBODIMENTS

It is to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Preferably the wave generator used in the present invention will not interfere with the chute, will be scalable to various sizes or applications, will be remotely controllable, and will be capable of generating ridable waves. Embodiments of the present invention may include one or more pneumatic wave cannons for the generation of waves, as may be desired for the application. Ocean surface waves are primarily created by winds that cause variations in surface pressure. Wind duration, strength, and surface coverage area contribute to the resulting wave. In short, the wave cannon, an example of which is disclosed in the '393 patent, transfers energy from the escape of compressed air to water to create swells or waves. When used in conjunction with appropriate hydrodynamic bottom contour, the wave can be rendered ridable or breaking.

The feature of the present invention may be configured to be stand-alone or used in conjunction with other water features. Because of the common element of a chute, it is anticipated that the present invention will be attractive for use as a ride or component of a water slide. Although the present invention may be configured to be used in conjunction with water slides, it need not necessarily be so. Thus, the description herein of use in conjunction with a water slide should not be construed as limiting.

Figure 1:
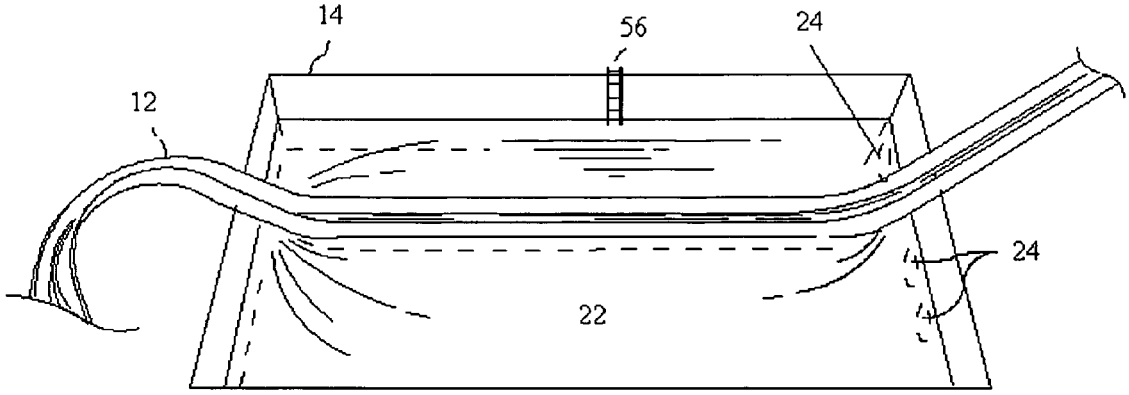
FIG. 1 is a perspective view of an embodiment of the present invention incorporated into a water slide.

With reference to the drawings, FIG. 1 is an embodiment of a water feature of the present invention incorporated into water slide 10. One or more chutes 12 of water slide 10 pass through pool 14 without chute 12 being completely submerged. The chute 12 may comprise two sides 16, an upstream end 18 and a downstream end 20. Pool 14 contains body of water 22 and is configured to support one or more wave generators 24, wherein the wave generator 24 may be located at the upstream end 18 of the chute 12.

Figure 2:
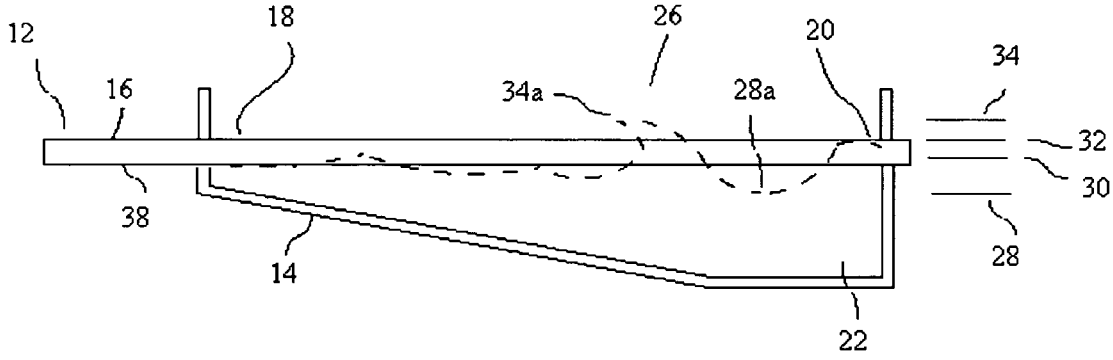
FIG. 2 is a side view of the embodiment in FIG. 1.
Figure 3:
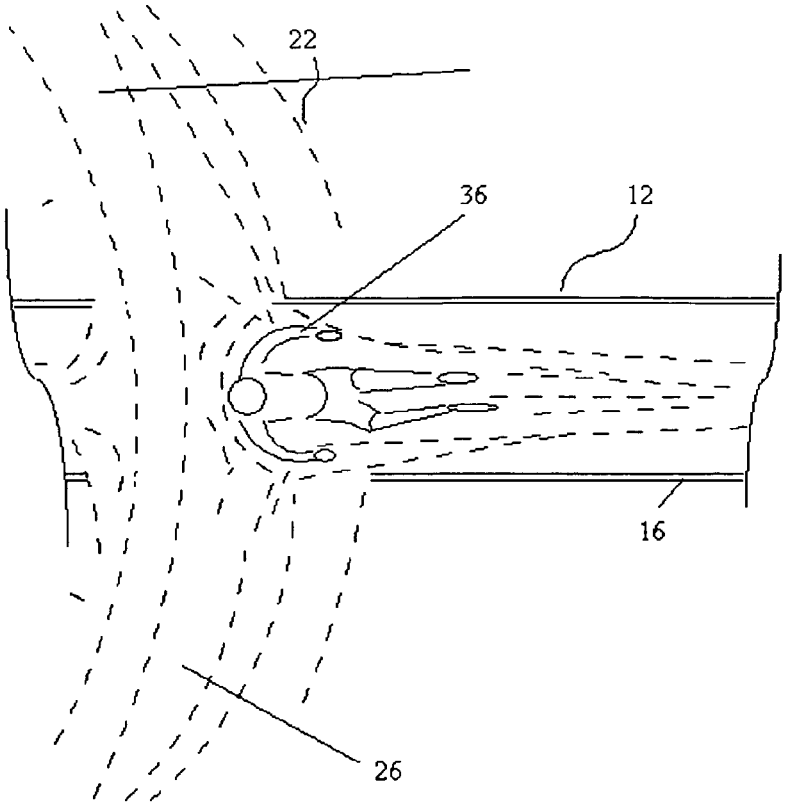
FIG. 3 is a top view of the embodiment in FIG. 1.

Chute 12 may enter and exit pool 14 in a variety of ways. As may be seen in the side view of FIG. 2, generated wave 26 flows or runs in a direction along the course of chute 12 located within pool 14. Various lines are shown representing relative levels: trough water level line 28 (trough water level 28*a*), resting water level line 30 (resting water level 30*a*), chute side level line 32 (top of side 16 of chute 12), and crest water level line 34 (crest water level 34*a*). The top of sides 16 of chute 12 may be configured so as to be above resting water level 30*a* of body of water 22, but below crest water level 34*a*, such that wave 26 may enter chute 12 at some cresting point during the wave cycle. Sides 16 of chute 12 preferably prevent a rider 36 from being moved out of chute 12 by wave 26. The chute 12 may further comprise a bottom 38, which may be above or below body of water 22 resting water level 30*a*, depending on the flow of water within chute 12 to propel the rider 36. Thus, water slide 10 is hydraulically associated with body of water 22 in pool 14 by cresting of wave 26 and its spillage into chute 12. For this embodiment, side 16 should permit sufficient quantity of wave 26 to be captured within chute 12 and bottom 38 of chute 12 inclines in such a manner as to render wave 26 within chute 12 ridable. FIG. 3 is a top view of a portion of chute 12, in which wave 26 spills into chute 12 and propels rider 36.

Figure 4:
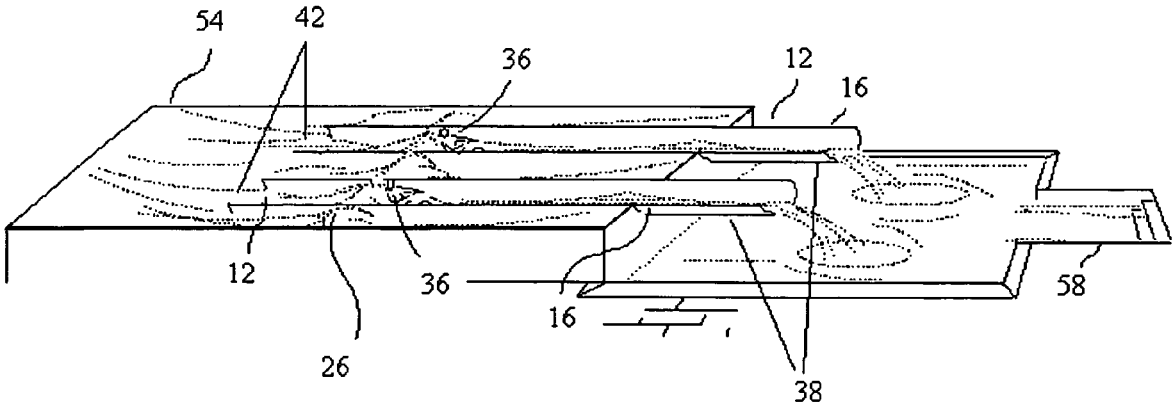
FIG. 4 is a perspective view of a wave racing embodiment of the present invention having multiple chutes open to a generated wave.

As shown in FIG. 4, multiple chutes 14 may be configured in parallel, such that sides 16 of chutes 12 may separate the water sliding riders 36 directly or through a separation space 40. In this embodiment, riders 36 may enter chutes 12 from pool 14 through a chute entry 41. In addition, chutes 12 are open in the end to wave 26. Chutes 14 preferably exit pool 14 after capturing portions of wave 26 within them for propelling riders 36 beyond pool 14 to any of a variety of following activities or features. Chutes 12 are parallel in this example and permit comparison or racing between riders 36.

As noted above in the first embodiment, chutes 12 may be situated at an appropriate depth in body of water 22 where chutes 12 are similarly partially submerged or swamped only during the passage of wave 26. Wave 26 may propel multiple riders 36 along their respective chutes 12. When generated wave 26 crests consistently across chutes 12, riders 36 may also race each other during a particular wave 26.

Figure 5A:
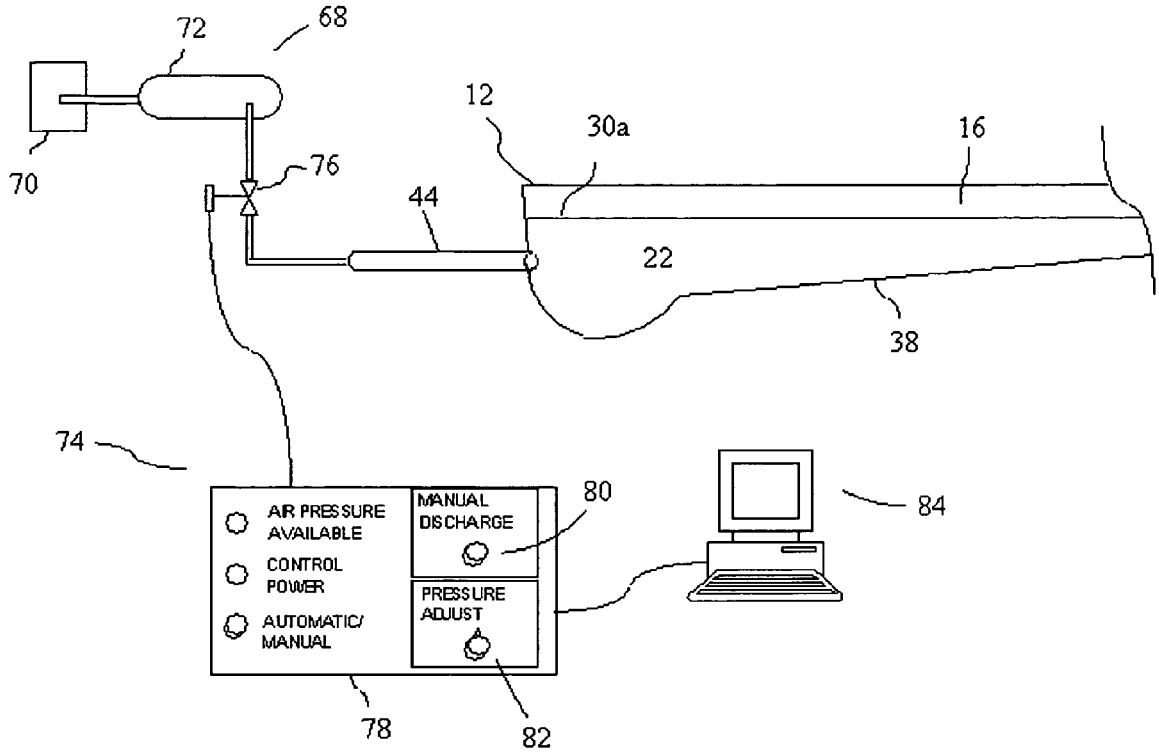
FIG. 5A is a schematic of a chute with an integrated wave generator.
Figure 5B:
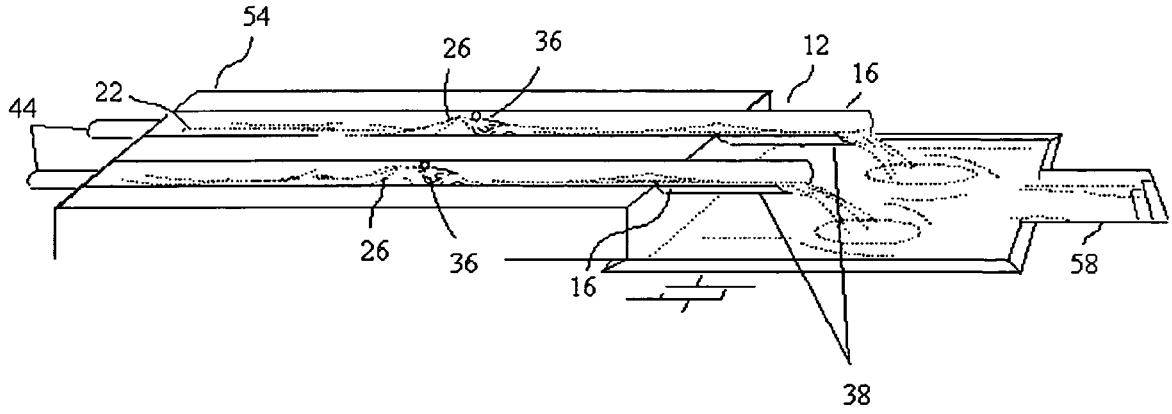
FIG. 5B is an illustration of a wave racing embodiment incorporating the design in FIG. 5A.

Alternatively, as shown in FIG. 5A, for chutes 12 capable of carrying a sufficient body of water 22, one or more non-interfering wave generators 24 may be configured so as to discharge directly into chute 12 for independently generating wave 26 within chute 12. Wave generator 24 preferably is scalable for use within chute 12 and does not interfere with typical water sliding activities. This example shows wave generator 24 in the form of pneumatic wave cannon 44. In such an integrated embodiment, sides 16 and/or orientation of chute 12 will preferably provide sufficient depth at the point of wave generation to channel sufficient energy to rider 36 (not shown). Optionally, it may be desirable for generated wave 26 (not shown) for multiple chutes 12 to spill over sides 16 out of chutes 12. Bottom 38 is shown inclined to render wave 26 ridable or breaking. Wave cannons 44 may be integrated within parallel chutes 12 and may be controlled or timed for simultaneous operation to support racing. FIG. 5B illustrates the present invention with chute 12 from FIG. 5A incorporated into a racing embodiment.

In general, the configuration of chutes 12 may be arranged to achieve a desired hydrodynamic effect. For example, an incline in bottom 38 in the same direction as that of wave 26 may be used to create normal breaker behavior within such chute 12, similar to that seen on a beach but contained within chute 12. If bottom 38 inclines to a peak (not shown), then this arrangement can be used to provide a natural point of termination of chute 12; the individual may exit chute 12 when the wave has receded or residue of wave 26 may be collected in subsequent chute 12. Residue of wave 26 may flow past a peak to continue to reduce friction as rider 36 may continue along chute 12 or to a subsequent feature.

For those embodiments in which it may be desirable to preserve energy imparted to a rider 36, then a less steep incline, with a substantially straight path for chute 12 may be appropriate. If turns in chute 12 are desired as features of interest, the available captured wave energy should be considered. In addition, the height of sides 16 of chute 12 may need to accommodate the redirection of captured portions of wave 26. Of course, if a terminal portion of chute 12 substantially declines, then energy preservation may be less of a design consideration, depending on subsequent features.

Figure 6:
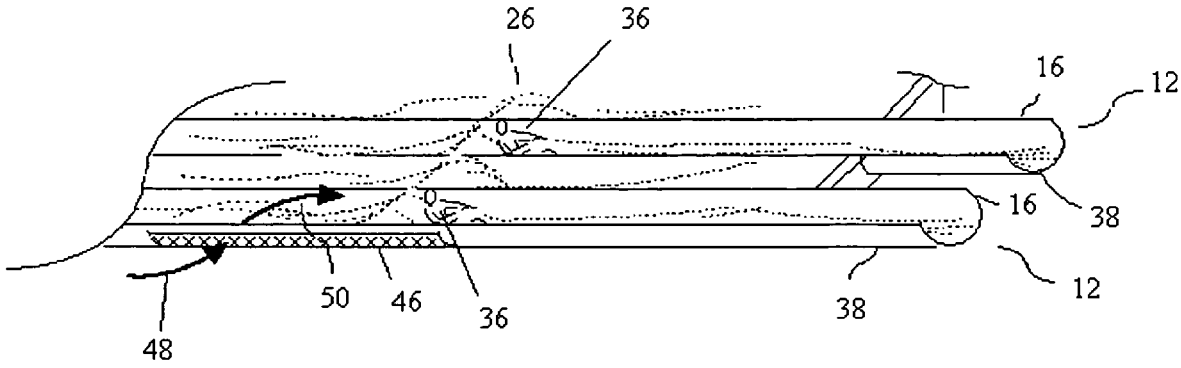
FIG. 6 is an example of the present invention in which a chute has perforations.

In another embodiment, a lower portion of chute 12 passing through pool 14 may include smooth perforations 46, such as slots, holes, or other openings over a predetermined distance, as illustrated in FIG. 6. Perforations 46 should be in communication with body of water 22 and permit wave 26 to pass through the structure of chute 12, as shown in entering arrow 48 and in-chute arrow 50, which shows possible wave motion within chute 12. Perforations 46 may end after a predetermined distance, enabling the capture of a portion of wave 26 within chute 12. Thus, each of wave 26 would inject a portion of wave 26 into chute 12, propelling riders 36 along the direction of wave 26.

In a further embodiment, the present invention may be used in conjunction with other known water features. For example, water slide 10 may provide speed drops, corkscrews, serpentine paths, bowl slides, etc. (not shown). The present invention may be adapted to such features without disrupting its utility. For example, wave cannon 44 may be recessed into the bottom 38 or sides 16 of chute 12, as shown in FIG. 5A, with smooth opening 52 for hydraulic communication, such as grill, so that water sliding activities will not be impeded; other acceptable mechanisms for smooth opening 52 could include retractable covers, slots, screens, etc.

Figure 7:
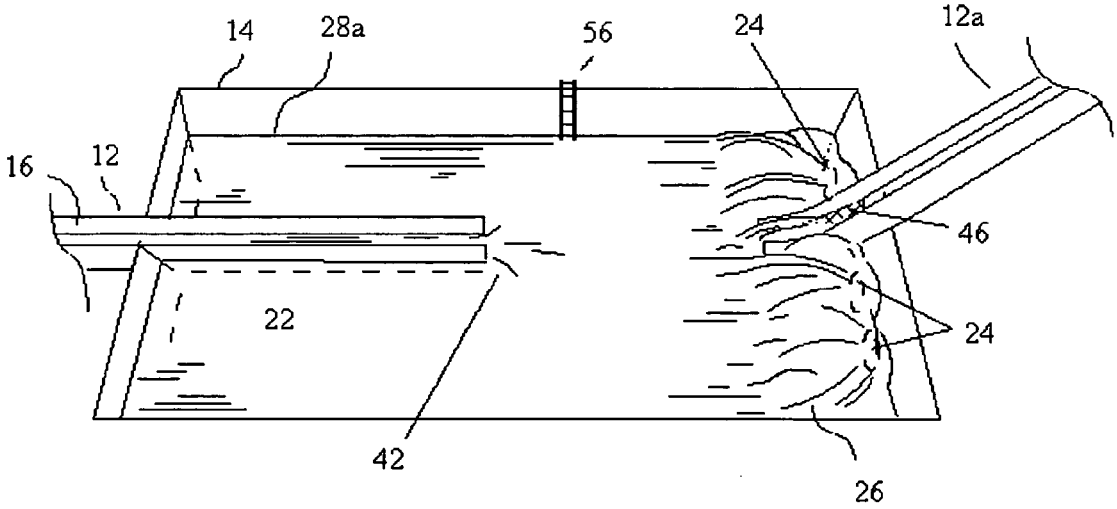
FIG. 7 is another example of the present invention incorporated into a water slide.
Figure 8:
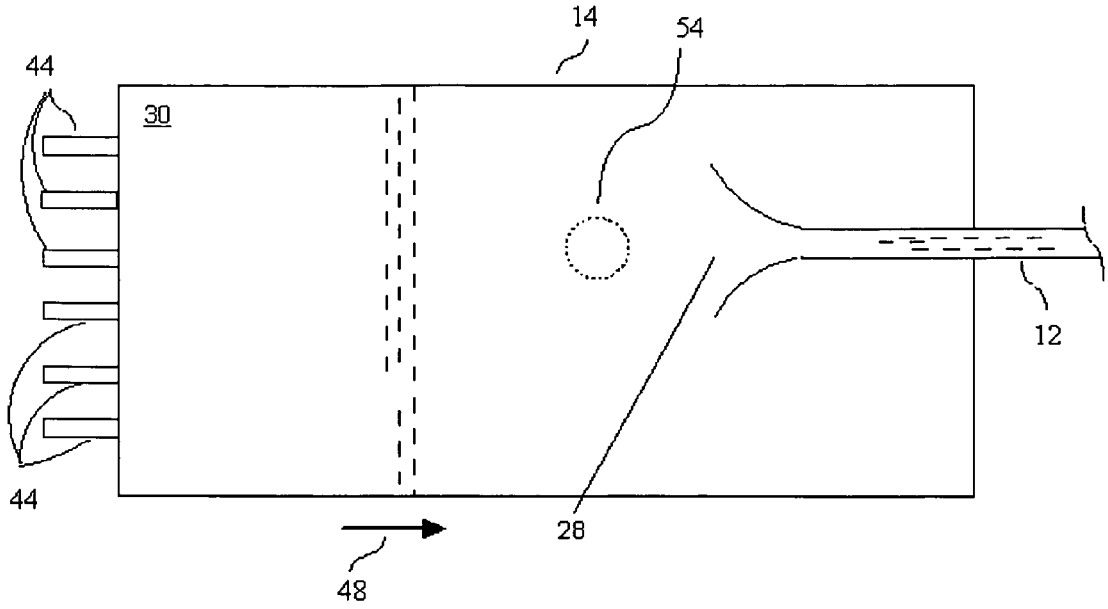
FIG. 8 is a top view of an embodiment of the present invention showing a chute open to a wave and a point of chute entry.

In another aspect illustrated in FIG. 7, rider 36 (not shown), traveling down a prior feature or a portion of water slide 10, such as a previous chute 12*a*, may be delivered directly into pool 14; rider 36 may continue sliding or remain in pool 14. Preferably, the portion of previous chute 12*a* within pool 14 (or any connection between previous chute 12*a* and chute 12) is configured so as to avoid or withstand the energy of wave 26, and to reduce any interference of previous chute 12*a* with the motion of wave 26, as applicable. In some cases, this interference may be reduced by perforations 46, as described above, that permit the water to move relatively unimpeded through previous chute 12*a*, while still supporting and constraining rider 36. In other cases, previous chute 12*a* may provide a small discontinuity, break, or drop off such that rider 36 is dropped into a sufficiently deep portion of pool 14 proximate to chute 12 located within pool 14. For example, FIG. 8 is an alternative in which rider 36 may be dropped into plunge area 54. Water slide 10 may include bowl slide (not shown) or other means to deliver rider 36 to plunge area 54 proximate to chute 12*a* within pool 14. Arrow 48 shows the direction of wave 26. Sides 16 of chute 12*a* may be flared near the chute entry 42, or optionally may gradually rise up to the full height so as to avoid concentration of wave 26 or injury to rider 36. Alternatively, in some embodiments it may be desired to concentrate wave 26 to enhance its effect within chute 12.

Alternatively, some embodiments will permit wave generator 24 to be recessed near the point where serpentine chute 12*a* and chute 12 come together. In that case, wave generator 24 may be triggered to discharge through smooth opening 52 when rider 36 is sensed as entering chute 12, in an embodiment similar to that shown in FIG. 5A.

Conventional methods of entering water features associated with the present invention are preferable; however, the entering method chosen should suit the application. In some embodiments, it may be desirable for one or more entrances 56 to be located near or in pool 14 or chute 12. For example, for designs in which chute 12 has integrated or dedicated wave cannons 44, rider 36 may enter from over side 16 of chute 12 during a coordinated pause in operation of wave cannon 44, so long as sides 16 are low enough. For an embodiment of water slide 10 having pool 14 between discrete features or portions of water slide 10, a simple approach may be entrance 56 in the form of a ladder to chute entry 42 within pool 14, as shown in FIG. 7. This approach may permit rider 36 (not shown) to begin, end, or resume riding water slide 10 from pool 14. As noted above, sides 16 of chutes 12 may rise and close gradually to avoid injury in the event of wave 26 occurring prior to rider 36 (not shown) fully taking position within chute 12, as shown in FIG. 8. If water slide 10 is designed for mats, then entrance 56 could be adapted to use of such devices, as is known in the art. Other arrangements (not shown), such as access platforms or steps, may also be appropriate depending on the application.

The exit of rider 36 from water features associated with the present invention is also preferably according to conventional arrangements. However, as noted above, for example, the present invention may also be adapted to deliver rider 36 to another feature or portion of a water slide 10 for subsequent sliding activities. The rider 36 need only retain sufficient momentum to complete sliding along chute 12 to the next feature. Of course, chute 12 should retain sufficient water and rider 36 should retain sufficient momentum. For example, as chute 12 inclines within the pool 14, then chute 12 may peak and then decline so as to carry rider 36 on remaining water to reach a follow on portion of chute 12 in water slide 10. Of course, pool 14, body of water 22, and chute 12 may be configured for a desired retention of water for pool 14 or for a desired transfer of water from body of water 22 to chute 12 and subsequent features. In some cases, after completion of riding the present invention, supplemental water jets (not shown) may be desirable to carry rider 36 to another feature or portion of water slide 10, as is known in the art. In an example of termination, rider 36 may be discharged from chute 12 directly into a separate plunge pool having exit 58, as shown in FIG. 4.

Figure 9:
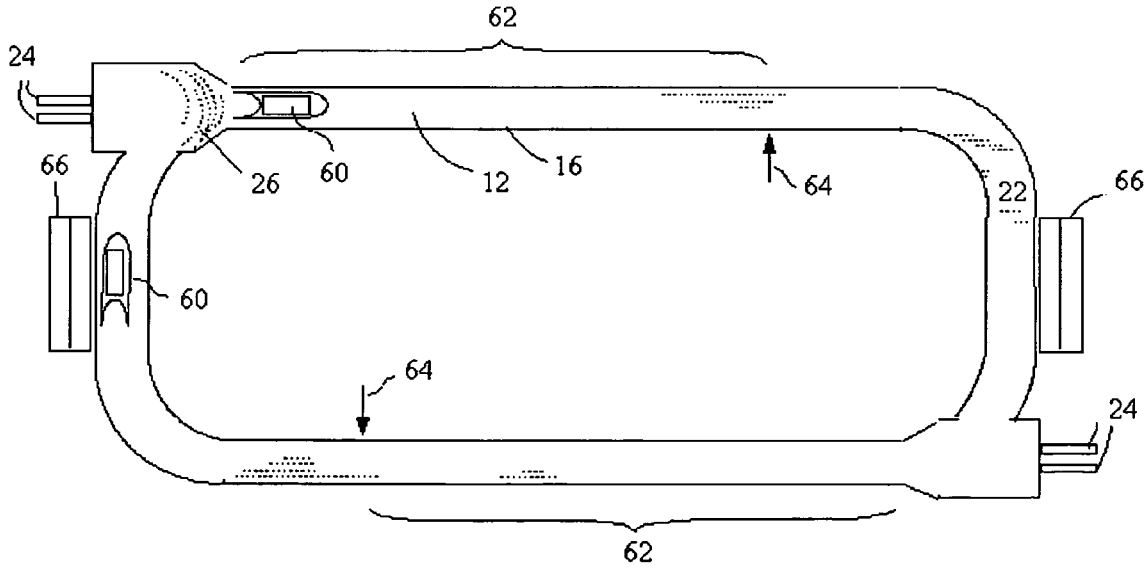
FIG. 9 is a top view of a large scale embodiment of the present invention employed as a ride and/or transportation.

In the example of FIG. 9, vessels 60 ride waves 26 along chute 12. This embodiment illustrates a ride that may also be used for transportation between two or more points within an amusement park. For stability purposes, vessels 60 may be multi-hulled, such as a catamaran. Wave generators 24 generate ridable waves 26 within body of water 22 along chute 12. Preferably, bottom 38 (not shown) inclines for the portion of chute 12 designated as inclining portion 62. Peaks in bottom 38 may be located at arrows 64, after which bottom 38 may decline or drop off such that wave 26 dissipates and vessel 60 slows. Station 66 may be a boat house, terminal, pier, or other facility where riders 36 (not shown) can embark or debark from vessels 60.

Preferably, discharge of wave generators 24 will be controlled or timed. For example, for those embodiments providing wave cannon 44 for racing in chutes 12 or for other themed scenarios, generation of wave 26 may be controlled to support such activities. FIG. 5A illustrates compressed gas compartment 68 for support of wave cannons 44, comprising a gas compressor 70, such as an air compressor, and a pressure storage tank 72. Typically, the compressed gas compartment 68 comprises a compressed air system. Preferably, the compressed gas compartment 68 is linked to control system 74 for control of wave cannons 44 through control valve 76 and control panel 78. Thus, wave cannons 44 may be controlled manually or automatically. Control panel 78 includes discharge button 80 for manual discharge and various indications, as may be appropriate for the application. Control system 74 preferably includes variable pressure adjust 82 for wave cannons 44 from compressed gas compartment 68. Variable charging of wave cannon 44 enables waves 26 of a variety of size and frequency, so as to match the age, size, and athletic level of rider 36, or to the conditions of a scenario theme. Preferably, control of wave cannon 44 may be automated or scripted through a computer processor 84 to activate wave cannon 44 as well as other features. Such a system may be linked with sensors detecting presence of riders 36, water levels, the weight of rider 36, etc.

Because of the scalability of some wave generators 24, such as wave cannon 44, the present invention may be employed in a variety of sizes and configurations. The above descriptions have concentrated on individual rider 36 within chute 12; in particular, the description referred to examples of use with water slide 10 as being a likely embodiment. However, the present invention may apply to different embodiments, including those using single or multi-person vessels configured to operate within a larger embodiment of chute 12.

Other devices for the generation of ridable waves may serve in the present invention, depending on the configuration of the facility and the desired effect. Importantly, the wave generation technology should not require structure that could interfere with the activity of the individuals or vessels within the chutes, particularly while sliding. In addition, the wave generator should preferably be capable of being scaled to a small or large size, controlled remotely, and recessed so as to present little structural intrusion into the chute. Those wave generators that require structure inserted into a body of flowing water, such as a wave form or body, would generally interfere with sliding. In addition, wave generators that are not scalable may be inappropriate for some water slide applications. Therefore, preferably the wave generator will be non-interfering, scalable, remotely controllable, and capable of generating ridable waves, such as a wave cannon.

In one embodiment, the wave cannon 44 of the present invention may comprise an improved wave generator 24, which may be located at the upstream end 18 of the chute 12. The wave generators 24 may be configured so as to discharge directly into chute 12 for independently generating wave 26 within chute 12. The at least one wave generator 24 may comprise an elongated tubular chamber 86 having a substantially closed rear end 88 and a substantially open front end 90. The wave generator 24 may further comprise an anchor 92 for securing the chamber 86 and maintaining the chamber 86 at a desired orientation with respect to the body of water 22. The anchor 92 may be coupled to the rear end 88 of the chamber.

In general, the release of compressed air that would discharge or expel all of the water from the chamber 86 would generate an effective wave 26. Specifically, a high pressure bubble is created within a rear end 88 of the elongated chamber 86 by the release of the compressed air. As the bubble expands, it expels the water within the chamber 86 out the front end 90. A side effect of expansion is that the pressure of the gas or air bubble declines during expansion. In the production of effective waves 26, water is intended to be expelled completely from the chamber 86. Some portion of the air would escape as large bubbles out the front end 90 of the chamber 86 into the body of water 22, while other portions of the air might be dispersed into the body of water 22 in a turbulent mix or froth, eventually reducing the pressure within the tube as water returned to refill the chamber 86. Thus, it had been contemplated that a water slug driven by a large volume gas bubble formed by the released air would produce the most effective discharge of water.

As discussed above, compressed air can be costly. However, the release of low quantities of pressurized air into the chamber 86 can create adverse effects beyond that of inferior waves. The release of smaller quantities of pressurized air into the chamber 86 can form a bubble that begins the expulsion of water, but the bubble can then decay to a low pressure condition within the chamber 86 prior to the full expulsion of water. This low pressure can cause water within the chamber 86 and previously expelled water to reverse direction and re-enter the chamber 86 via the front end 90 as the bubble collapses and air is dispersed. The low pressure bubble can collapse violently as higher pressure water strikes the rear end 88 of the chamber 86. In some embodiments, a vacuum exceeding 10 bar has been observed. Of course, the resulting impact could damage the chamber 86, requiring both substantial anchoring of the chamber and the use of "heavy" materials for fabrication of the chamber. However, it has been discovered that the reverse in direction of expelled water creates suction into the chamber 86 from the body of water 22, which can be unsafe for individuals swimming or surfing in the vicinity.

An aspect of the present invention is a system for mitigating this low pressure condition within the discharge chamber 86, while also enabling the discharge of sufficient water from the chamber 86 to generate effective wave motion within the body of water 22. Preferably, this mitigation may be accomplished by the introduction of fluid into the elongated chamber 86 to reduce such a low pressure condition and to prevent, or reduce the effects of, a reverse flow of expelled water. Of course the fluid may be any of a wide variety of liquids, gasses or mixtures thereof, depending upon the application. Preferably the fluid is water and/or air when available, for simplicity of design. Preferably also, the location for the make-up source introduction of fluid is at the substantially closed rear end 88 of the discharge chamber 86, also for simplicity of design.

Figure 10:
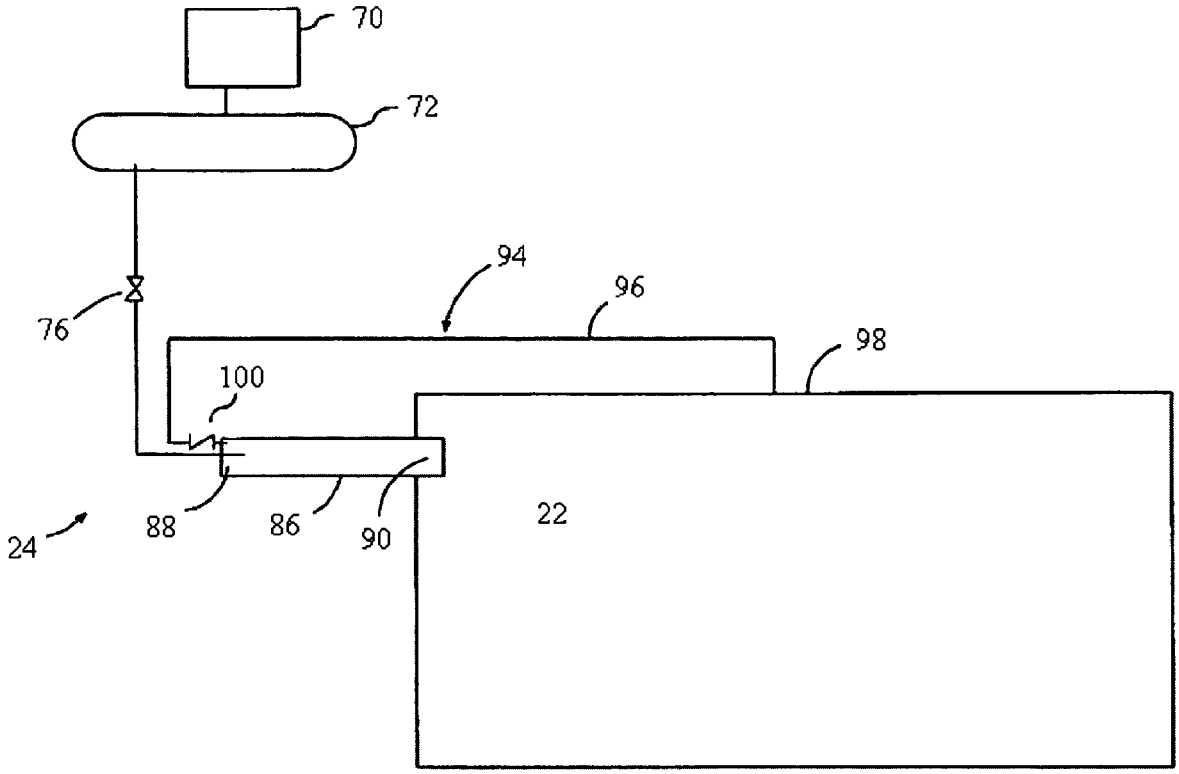
FIG. 10 is a schematic overview of an embodiment of the present invention.

FIG. 10 is an embodiment of the present invention directed to wave generation, wherein wave cannon 44 is configured with respect to body of water 22, such as wave pool. The invention further comprises a make-up system 94 directed to mitigating low pressure conditions within chamber 86. A make-up fluid conduit 96, such as a pipe or hose, having make-up fluid provides a mechanism for water from make-up source 98 of fluid (i.e., in this case body of water 22) to be introduced into the chamber 86 when the pressure within chamber 86 drops below a desired setting. For example, make-up fluid conduit 96 could connect to body of water 22 at a particular depth, so that the actuation pressure for introduction of make-up fluid might simply be the water pressure for the depth at the point of connection. Thus, the predetermined low pressure may be any pressure in chamber 86 relatively lower than that of the body of water 22 at the connection. Accordingly, in such cases the mass of fluid introduced by make-up fluid conduit 96 would be zero for a pressure in chamber 86 equal to that in the body of water 22 at the connection and would increase as the relatively low pressure in chamber 86 increases with respect to that at the body of water 22.

This embodiment is thus a wave generating device having an elongated chamber 86 oriented such that body of water 22 may fill the chamber 86 via a substantially open front end 90, a supply of compressed air (i.e., supported by air compressor 70) fluidly interconnected with chamber 86. The chamber 86 may be oriented such that the slope between the rear end 88 and the front end 90 ranges from about 0 to about 5 percent.

The air control valve 76 of the present invention may be in fluid communication with the supply of compressed air in the compressed gas compartment 68 for controlling the flow of compressed air into chamber 86. Additionally, the make-up fluid conduit 96 may be fluidly connected to chamber 86, wherein the air control valve 76 can release the compressed air into chamber 86 to expel water within the chamber 86 out of the front end 90 and further wherein the make-up fluid conduit 96 can introduce make-up fluid, such as gas, liquid and mixtures thereof, into the chamber 86 to replace at least some of the water expelled out of the front end 90. Optionally, the make-up fluid conduit 96 may be located at the substantially closed rear end 88 of the chamber.

When pressurized air is released into the chamber 86, pressure within chamber 86 initially increases. Water within chamber 86 is expelled from chamber 86 and into body of water 22 along front end 90. If a low pressure is formed within the chamber 86 during this process (e.g., at substantially closed rear end 88), then water from the make-up fluid conduit 96 would be introduced into the chamber 86 to mitigate or relieve the low pressure condition. A fluid control valve 100, such as a check valve or other actuating control valve (not shown), is preferably inserted into the make-up fluid conduit 96 in order to control the release of fluid into chamber 86. Because make-up fluid conduit 96 is directed to flow into chamber 86, such a valve may be useful for controlling the release to a desired low pressure level and to prevent back flow from chamber 86 into make-up fluid conduit 96. In an alternative embodiment, such a valve could be fluidly connected to atmosphere such that atmospheric air could be released into chamber 86 for mitigation of a low pressure condition.

Figure 11:
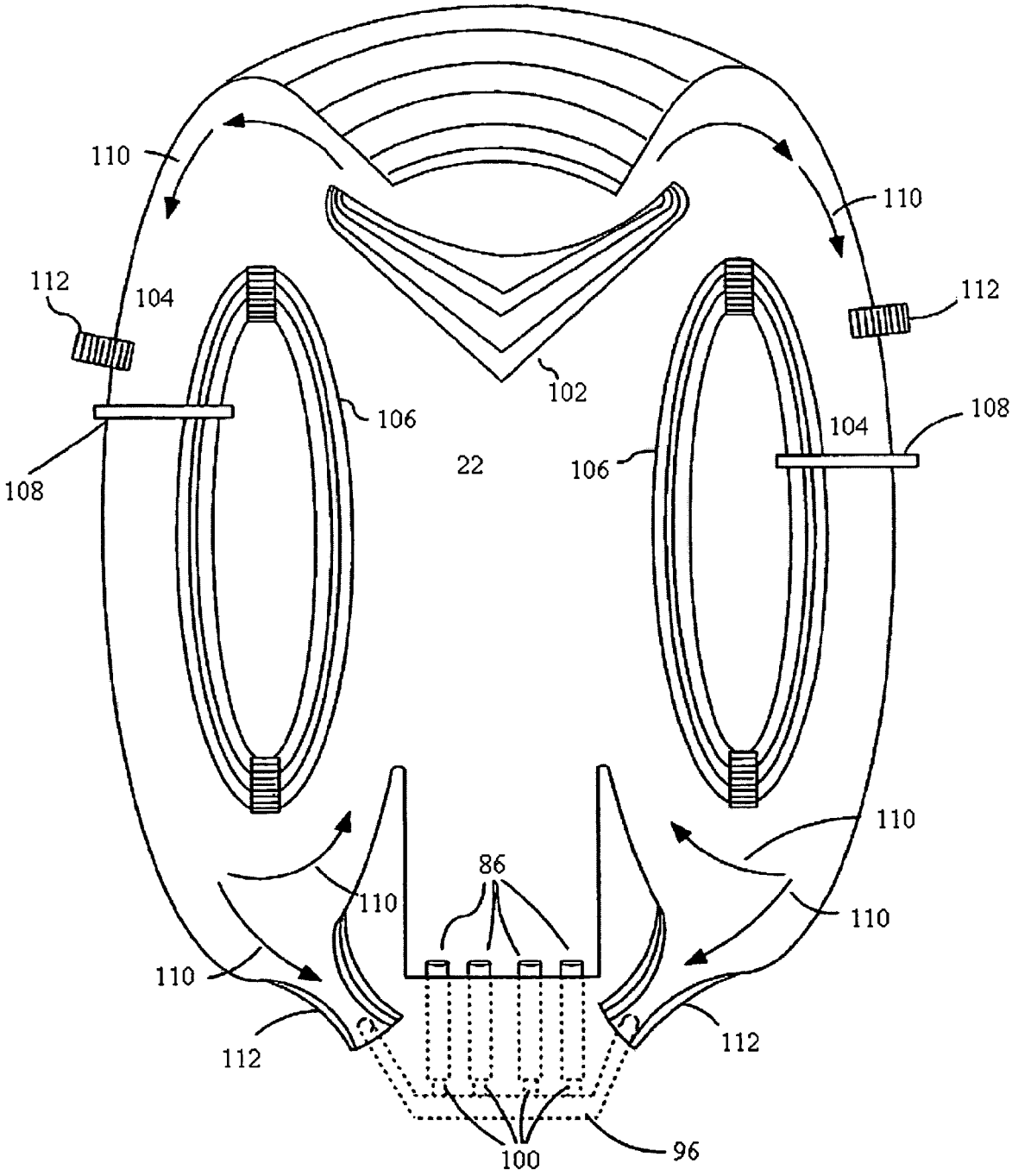
FIG. 11 is a top view of a wave pool embodiment of the present invention.

FIG. 11 shows a related embodiment that illustrates the usefulness of make up for wave generator chambers 86, in which body of water 22 is configured as a wave pool. Waves are generated from chamber 86 in the direction of a reef 102. Optionally, the make-up fluid conduit 96 may collect overflow fluid from a drainage system, or other desired make-up source. Additionally, the water feature may comprise a river return 104 or a plurality of river returns within the body of water 22 to collect overflow fluid from a body of water. In one embodiment, the make-up fluid conduit 96 may comprise the river return 104 to introduce fluid into chamber 86 to mitigate low pressure conditions. Alternatively, the river return 104 may be formed by integrated islands 106 and reef 102 within wave pool types of body of water 22, or they may comprise a lazy river or action river return. For orientation, integrated islands 106 are shown with bridges 108 for access. Directional arrows 110 show current flow; this configuration of body of water 22 and make-up fluid will increase the flow along river returns 104. Surfers may ride river returns 104 to travel from the location in body of water 22 where waves break on reef 102 to the point of wave generation near chamber 86. Personnel access points 112 may be provided at the point where make-up fluid conduit 96 draws from river return 104. Those skilled in the art may accommodate chute 12 (not shown) of the present invention within such facilities.

Figure 12:
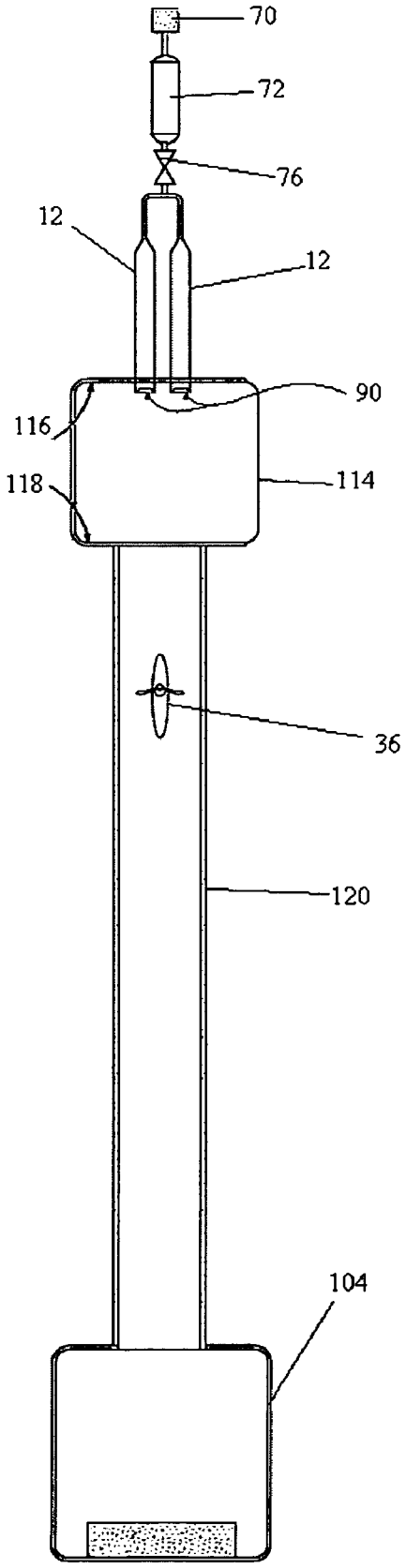
FIG. 12 is a side view of water feature of the present invention.
Figure 13:
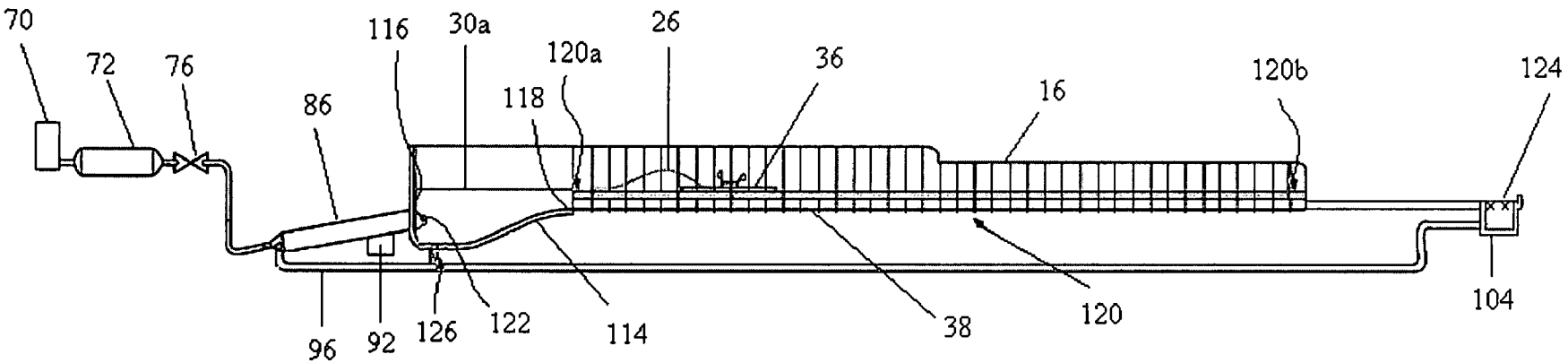
FIG. 13 is a top view of the embodiment in FIG. 12.

Optionally, the water feature of the claimed invention may be configured as shown in FIGS. 12 and 13, wherein the water feature further comprises a basin 114 having a basin proximal end 116 and a basin distal end 118. Typically, the basin 114 is located upstream of the chute 12 and downstream of the wave generator 24. As shown in FIG. 13, the bottom 38 and two sides 16 of the chute 12 defining a channel 120 having a channel proximal end 120*a* and a channel distal end 120*b*, which may be in fluid communication with the basin proximal end 116. The channel 120 is adapted to contain at least a portion of the body of water 22 within the chute 22. The wave generator 24, basin 114 and channel 120 may be configured such that when the wave generator 24 generates a wave 26 within the body of water 22, the basin 114 is adapted to receive the wave 26 and the channel 120 is adapted to receive from the basin 114 at least a portion of the wave 26 within the portion of the body of water 22 contained within the chute 12 to propel the rider 36 along the channel 120.

This embodiment may also contain a make-up fluid conduit 96 in fluid communication with the chamber 86 of the wave generator 24, wherein actuation of the gas control valve 76 is capable of causing compressed gas to be released into the rear end 88 of the chamber 86 to forcibly expel fluid within the chamber 86 out of the open front end 90 into the body of water 22. The make-up fluid conduit 96 of this embodiment is also adapted to introduce fluid into the rear end 88 of the chamber 86 to relieve low pressure in the chamber 86.

The basin 114 may be used a generating area for wave 26, wherein the basin 114 is in fluid communication with the front end 90 of the chamber 86, which may comprise a discharge check valve 122 coupled to a portion of the front end 90 of the chamber 86 to enable the discharge of the chamber 86 to the body of water 22 but substantially inhibit reverse flow from the body of water 22 into the front end 90 of the chamber 86. Actuation of the wave generator 24 may generate wave 26 in basin 114, which would allow the wave 26 to subsequently move into the chute 12 to transfer the rider 36 through the channel 120. Optionally, the dissipated wave may be received in the river return 104 through the collection grate 124 to replenish the fluid in the make-up fluid conduit 96 or the basin 114 (not shown). In this embodiment, the channel proximate end 120*a* of the channel 20 is typically below the resting water level 30*a* and the channel distal end 120*b* is typically above the resting water level 30*a*, to ensure that the wave 26 is captured in the collection grate 124. In another embodiment, the upstream end 18 of the chute 12 is above the resting water level 30*a* and the downstream end 20 of the chute 12 is below the resting water level 30*a*. The fluid collected in the collection grate 124 may not be sufficient to substantially fill the make-up conduit 96. Accordingly, the water feature may further comprise an equalizing valve 126 to replenish any fluids that the collection grate 124 does not provide. In one embodiment, as shown in FIG. 13, the equalizing valve is located on a portion of the basin 114, preferably along the basin 114 on a location that is below the trough water level 28*a*.

Thus, in summary, an aspect of the present invention is that the volume of compressed or pressurized air released into the chamber 86 may be reduced, depending on the nature of the application, without causing a violent bubble collapse due to a low pressure condition in the chamber 86. The present invention reduces the consumption of compressed or pressurized air (or other gas), which also reduces the operating cost. A further aspect of the present invention is that the mitigation of a low pressure condition within the chamber 86 reduces the tendency of the low pressure to place a drag on the water expelled from the chamber 86. Accordingly, the present invention enables a reduction of the compressed air used along with little or no decrease in the ability to expel water, and little or no decrease in the quality or effectiveness of waves generated. Further, the invention enables a reduction in the heaviness of materials of construction.

For example, with one embodiment of the present invention, a wave cannon 44 discharge chamber 86 having a cross sectional area of about 4 sq. feet and a length of about 24 feet produced an effective wave using a release of air about 30-40% the volume as previously required. In fact, this wave cannon 44 was able to generate a 7 foot wave, which had previously only been demonstrated by a release of air sufficient to clear a chamber having a cross sectional area of 9.6 sq. feet and a length of 80 feet.

The above examples should be considered to be exemplary embodiments, and are in no way limiting of the present invention. Thus, while the description above refers to particular embodiments of the present invention, it will be understood that many modifications may be made without departing from the spirit thereof.

What is claimed is:

1. A water feature for propelling a rider, the water feature comprising:

a basin for containing a body of water, the basin having a basin proximal end and basin distal end;

a water slide chute having a bottom and two sides, the bottom and two sides defining a channel suitable for receiving a rider, the channel having a channel proximal end and a channel distal end, the channel being in fluid communication with the basin and the body of water at the channel proximal end, the channel further adapted to contain at least a portion of the body of water within the chute;

at least one wave generator adapted to generate at least one wave within the body of water, the wave generator comprising:

an elongated tubular chamber having a substantially closed rear end and a substantially open front end wherein the body of water is in fluid communication with the substantially open front end of the chamber;

an anchor for securing the chamber and for maintaining the chamber in a desired orientation with respect to the basin proximal end and the body of water;

a gas compression compartment in fluid communication with the substantially closed rear end of the chamber;

a gas control valve in fluid communication with the gas compression compartment and the chamber, the gas control valve adapted to operatively control the flow of compressed gas from the gas compression compartment to the chamber;

a make-up fluid conduit in fluid communication with the chamber;

wherein actuation of the gas control valve is capable of causing compressed gas to be released into the rear end of the chamber to forcibly expel fluid within the chamber out of the open front end into the body of water;

wherein the make-up fluid conduit is adapted to introduce fluid into the rear end of the chamber to relieve low pressure in the chamber; and wherein the wave generator, the basin, and the channel are configured so that when the wave generator generates at least one wave within the body of water, the basin proximal end is adapted to receive the at least one wave and the channel proximal end is adapted to receive from the basin at least a portion of the at least one wave within at least a portion of the body of water contained within the chute to propel the rider in a distal direction along the channel.

2. The water feature of claim 1, the water feature further comprising at least one river return to collect overflow fluid from the body of water, wherein the river return is in fluid communication with the body of water and the make-up fluid conduit.

3. The water feature of claim 2, the make-up fluid conduit comprising a supply of make-up fluid.

4. The water feature of claim 3, wherein the supply of make-up fluid is selected from the group consisting of gas, liquid and mixtures thereof.

5. The water feature of claim 3, the wave generator further comprising a fluid control valve in fluid communication with the make-up fluid conduit and the rear end of the chamber, wherein the fluid control valve is adapted to control the introduction of fluid into the chamber, and wherein actuation of the fluid control valve causes the make-up fluid to flow into the rear end of the chamber when the chamber reaches a predetermined low pressure.

6. The water feature of claim 5, wherein the fluid control valve is a check valve.

7. The water feature of claim 1, wherein the gas compression compartment comprises a compressed gas tank and a gas compressor, wherein the compressed gas tank is fluidly connected to the gas compressor.

8. The water feature of claim 7, wherein the volume of the compressed gas tank is at least equal to the volume of the chamber.

9. The water feature of claim 1, the water feature further comprising a discharge check valve coupled to a portion of the front end of the chamber to enable the discharge of the chamber to the body of water but substantially inhibit reverse flow from the body of water into the front end of the chamber.

10. The water feature of claim 1, wherein the chute comprises a plurality of chutes, and wherein the plurality of chutes are juxtaposed in parallel fashion.

11. The water feature of claim 1, the wave generator further comprising at least one computer processor and a control system operably connected between the gas compression compartment and the computer processor so as to enable computer control of the wave generator.

12. The water feature of claim 1, wherein the chamber is positioned at an incline such that the slope between the rear end and the front end of the chamber ranges from about 0 to about 5 percent.

13. The water feature of claim 1, the water feature further comprising a pool, wherein at least a portion of the chute is located within the pool and wherein at least a portion of the body of water is located within the pool.

14. The water feature of claim 1, the water feature further comprising a collection grate in fluid communication with the make-up fluid conduit.

15. A water feature for propelling a rider, the water feature comprising:

at least one pool containing a body of water having a resting water level;

a water slide chute having a bottom, two sides, an upstream end, and a downstream end, wherein at least a portion of the chute is contained within the pool;

at least one wave generator for generating at least one wave within the body of water, the wave generator in fluid communication with the pool, the wave generator comprising:

an elongated tubular chamber having a substantially closed rear end and a substantially open front end;

an anchor for securing the chamber and for maintaining the chamber in a desired orientation with respect to the body of water, wherein the body of water is in fluid communication with the substantially open front end of the chamber;

a gas compression compartment in fluid communication with the substantially closed rear end of the chamber;

a gas control valve in fluid communication with the gas compression compartment and the chamber, the gas control valve adapted to operatively control the flow of compressed gas from the gas compression compartment to the chamber;

a make-up fluid conduit in fluid communication with the rear end of the chamber;

wherein actuation of the gas control valve causes compressed gas to be released into the rear end of the chamber to forcibly expel fluid within the chamber out of the open front end into the body of water;

wherein the make-up fluid conduit is adapted to introduce fluid into the rear end of the chamber to relieve low pressure in the chamber; and wherein the wave has a trough water level in the body of water below the resting water level and a crest water level in the body of water above the resting water level, and wherein the chute is aligned in the direction of the wave and that the top of the sides of the portion of the chute contained within the pool are above the resting water level and below the crest water level, such that a portion of the at least one wave enters the chute in a direction moving from the upstream end to the downstream end of the chute.

16. The water feature of claim 15, wherein the wave generator is not contained within the chute.

17. The water feature of claim 15, wherein the chamber is positioned at an incline such that the slope between the rear end and the front end of the chamber ranges from about 0 to about 5 percent.

18. The water feature of claim 15, the water feature further comprising a collection grate in fluid communication with the make-up fluid conduit.

19. A water feature for propelling a rider, the water feature comprising:

a water slide chute having a bottom, two sides, an upstream end, and a downstream end, wherein the chute is adapted to contain at least a portion of a body of water within the chute;

at least one wave generator adapted to generate at least one wave within the body of water, with the chute being aligned in the direction of the wave and being adapted to receive the wave, and the wave generator and top sides of the chute are configured such that the top of the sides of the chute are above a resting water level of the water and below a crest water level of the wave, and wherein the wave generator is located at the upstream end of the chute, the wave generator comprising:

an elongated tubular chamber having a substantially closed rear end and a substantially open front end;

an anchor for securing the chamber and for maintaining the chamber in a desired orientation with respect to the body of water, wherein the body of water is in fluid communication with the substantially open front end of the chamber;

a gas compression compartment in fluid communication with the substantially closed rear end of the chamber;

a gas control valve in fluid communication with the gas compression compartment and the chamber, the gas control valve adapted to operatively control the flow of compressed gas from the gas compression compartment to the chamber;

a make-up fluid conduit in fluid communication with the chamber;

wherein actuation of the gas control valve is capable of causing compressed gas to be released into the rear end of the chamber to forcibly expel fluid within the chamber out of the open front end into the body of water at the upstream end of the water slide chute and so as to travel along the chute toward the downstream end;

wherein the make-up fluid conduit is adapted to introduce fluid into the rear end of the chamber to relieve low pressure in the chamber;

a fluid control valve in fluid communication with the make-up fluid conduit and the rear end of the chamber, wherein the fluid control valve is adapted to control the introduction of fluid into the chamber, and wherein actuation of the fluid control valve causes the make-up fluid to flow into the rear end of the chamber when the chamber reaches a predetermined low pressure; and the water feature further comprises a basin in fluid communication with the wave generator and chute, wherein the basin contains at least a portion of the body of water, and wherein the basin is located upstream of the chute and downstream of the wave generator.

20. The water feature of claim 19, the water feature further comprising at least one river return to collect overflow fluid from the body of water, wherein the river return is in fluid communication with the body of water and the make-up fluid conduit.

21. The water feature of claim 20, the water feature further comprising a sensor, wherein the sensor is linked to the water feature and is adapted to detect the presence of the rider.

* * * * *